US011160305B2

(12) United States Patent
Branton

(10) Patent No.: US 11,160,305 B2
(45) Date of Patent: Nov. 2, 2021

(54) ADDITIVE RELEASING MATERIALS

(71) Applicant: British American Tobacco (Investments) Limited, London (GB)

(72) Inventor: Peter Branton, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 247 days.

(21) Appl. No.: 15/028,523

(22) PCT Filed: Oct. 10, 2014

(86) PCT No.: PCT/GB2014/053046
§ 371 (c)(1),
(2) Date: Apr. 11, 2016

(87) PCT Pub. No.: WO2015/052528
PCT Pub. Date: Apr. 16, 2015

(65) Prior Publication Data

US 2016/0249675 A1 Sep. 1, 2016

(30) Foreign Application Priority Data

Oct. 11, 2013 (GB) ..... 1318055

(51) Int. Cl.
*A24D 3/06* (2006.01)
*A24D 3/16* (2006.01)
(Continued)

(52) U.S. Cl.
CPC ..... *A24D 3/061* (2013.01); *A24D 3/0275* (2013.01); *A24D 3/06* (2013.01); *A24D 3/12* (2013.01); *A24D 3/16* (2013.01)

(58) Field of Classification Search
CPC ..... A24D 3/061; A24D 3/0275
(Continued)

(56) References Cited

U.S. PATENT DOCUMENTS 3,236,244 A * 2/1966 Irby, Jr. ..... A24B 15/282 131/274
3,972,335 A 8/1976 Tiggelbeck
(Continued)

FOREIGN PATENT DOCUMENTS

GB 973845 A2 5/1963
GB 988811 A2 3/1964
(Continued)

OTHER PUBLICATIONS

Ismadji, S. & Bhatia, S. K. (2000). Adsorption of Flavour Esters on Granular Activated Carbon. The Canadian Journal of Chemical Engineering, 78, 892-901. (Year: 2000).*
(Continued)

*Primary Examiner* — Eric Yaary
*Assistant Examiner* — Russell E Sparks
(74) *Attorney, Agent, or Firm* — Cantor Colburn LLP

(57) ABSTRACT

The invention relates to an additive releasing material comprising a carrier material having on its surface one or more additives, the additive releasing material having a desorption temperature selected to allow controlled temperature-dependent release of the additive(s). The invention further relates to filters and smoking articles including such additive releasing materials, and to methods for preparing the additive releasing materials.

15 Claims, 1 Drawing Sheet

(51) Int. Cl.
*A24D 3/02* (2006.01)
*A24D 3/12* (2006.01)

(58) Field of Classification Search
USPC ..... 131/335
See application file for complete search history.

(56) References Cited

U.S. PATENT DOCUMENTS

| | | | | |
|---|---|---|---|---|
| 4,753,250 | A * | 6/1988 | Bitter | A24D 3/166 131/334 |
| 5,228,464 | A * | 7/1993 | Owens, Jr. | A24D 1/02 131/365 |
| 6,761,174 | B2 * | 7/2004 | Jupe | A24D 3/048 131/201 |
| 8,286,642 | B2 * | 10/2012 | Woodson | A24D 1/00 131/372 |
| 2002/0062833 | A1 | 5/2002 | Xue | |
| 2002/0166563 | A1 | 11/2002 | Jupe | |
| 2003/0154993 | A1 | 8/2003 | Paine | |
| 2003/0159703 | A1 | 8/2003 | Yang | |
| 2005/0172976 | A1 | 8/2005 | Newman | |
| 2006/0090769 | A1 | 5/2006 | Woodson | |
| 2006/0112964 | A1 | 6/2006 | Jupe | |
| 2006/0130856 | A1 | 6/2006 | McCormack | |
| 2006/0272662 | A1 | 12/2006 | Jupe | |
| 2007/0181141 | A1 | 8/2007 | Xue | |
| 2007/0204869 | A1 | 9/2007 | Sampson | |
| 2007/0261706 | A1 | 11/2007 | Banerjea | |
| 2008/0110470 | A1 * | 5/2008 | Zhuang | A24B 15/245 131/331 |
| 2008/0314400 | A1 | 12/2008 | Yang | |
| 2011/0083686 | A1 | 4/2011 | Yang | |
| 2011/0240046 | A1 | 10/2011 | Hasegawa | |

FOREIGN PATENT DOCUMENTS

| | | | |
|---|---|---|---|
| GB | 1058343 | A2 | 3/1965 |
| GB | 1129173 | A2 | 4/1966 |
| GB | 1058342 | A | 2/1967 |
| GB | 1403813 | A2 | 8/1975 |
| GB | 2395650 | A | 6/2004 |
| KR | 950005400 | B1 | 5/1995 |
| WO | 2004041007 | A2 | 5/2004 |
| WO | 2004047571 | A2 | 6/2004 |
| WO | 2005082180 | A2 | 9/2005 |
| WO | 2005115182 | A2 | 12/2005 |
| WO | 2009080369 | A2 | 7/2009 |
| WO | 2012000646 | A1 | 1/2012 |
| WO | 2012053251 | A1 | 4/2012 |
| WO | 2012076649 | A1 | 6/2012 |
| WO | 2012168699 | A1 | 12/2012 |

OTHER PUBLICATIONS

Leffingwell, J. C., Young, H. J., Bernasek, E.. Tobacco Flavoring for Smoking Products. R. J. Reynolds Tobacco Company (Year: 1972).*

International Preliminary Report on Patentabilty for corresponding application No. PCT/GB2014/053046 filed Oct. 10, 2014; dated Jan. 22, 2016.

International Search Report for corresponding application No. PCT/GB2014/053046 filed Oct. 10, 2014; dated Feb. 20, 2015.

K.G. McAdam, "Design and chemical evaluation of reduced machine-yield cigarettes", Regulatory Toxicology and Pharmacology 62 (2012) 138-150.

Steve W. Purki, "The Influence of Cigarette Designs and Smoking Regimes on Vapour Phase Yields", Beiträge zur Tabakforschung International/Contributions to Tobacco Research vol. 24, No. 1, Apr. 2010.

Written Opinion for corresponding application No. PCT/GB2014/053046 filed Oct. 10, 2014; dated Feb. 20, 2015.

* cited by examiner

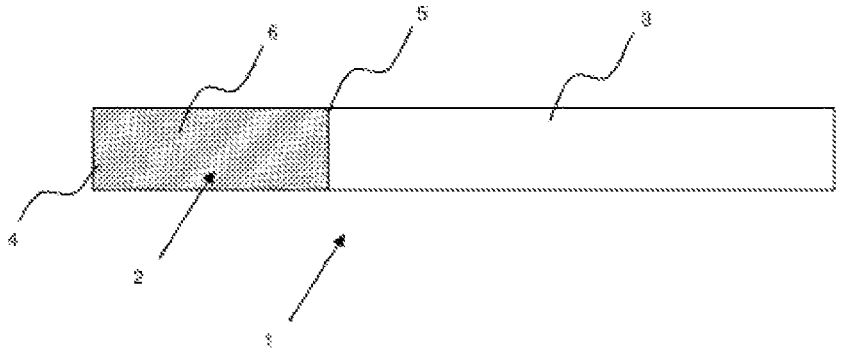
6
5
3
4
2
1

ADDITIVE RELEASING MATERIALS

FIELD

The invention relates to additive releasing materials which allow for temperature-dependent release of the additive. In particular, the materials may be suitable for inclusion in a smoking article or an inhalation device.

BACKGROUND

Smoking article filters may include porous materials to adsorb certain smoke constituents, typically by physisorption.

Additives may be added to smoking articles which are released into the tobacco smoke to provide a variety of effects. For example, where permitted under local regulation, smoking articles may include flavours to create a desired taste or aroma in a product for adult consumers.

SUMMARY

According to a first aspect of the invention, there is provided an additive releasing material comprising a carrier material having on its surface one or more additives, the additive releasing material having a desorption temperature selected to allow controlled temperature-dependent release of the additive(s).

In some embodiments, the additive(s) and/or the amount thereof added to the carrier material are selected to provide the additive releasing material with the desired desorption temperature.

In some embodiments, the additive releasing material releases the additive(s) by desorption when the material is exposed to a temperature within a predetermined threshold range.

In some embodiments, the additive releasing material does not release the additive(s) until the material is exposed to a temperature within a predetermined threshold temperature range.

In some embodiments, the predetermined threshold temperature range is the temperature range the additive releasing material is exposed to at the point or during the period when release of the additive(s) is desired.

In some embodiments, the additive releasing material has a desorption temperature of at least about 35 ° C.

In some embodiments, the carrier is a porous material. In some embodiments, the porous carrier has micropores, mesopores and/or macropores within which the additive is held.

In some embodiments, the porous carrier is a material selected from the group consisting of: activated carbon, resins, zeolites, silicas, sepiolite and other porous clays.

In some embodiments, the desorption temperature of the additive releasing material is from about 45 ° C., about 55 ° C., about 60 ° C. or about 65 ° C., and up to about 60° C., about 65 ° C. or about 70 ° C.

In some embodiments, the additive releasing material is for use in a smoking article.

In some embodiments, the additive releasing material has a desorption temperature such that the additive(s) is (are) released at a predetermined point during the use of the smoking article.

According to a second aspect of the present invention, a filter for a smoking article is provided, comprising filter material and an additive releasing material according to the first aspect of the invention.

In some embodiments, the filter further comprises an adsorbent material which does not carry an additive on its surface. In some embodiments, the adsorbent material provides the selective adsorption of certain constituents of the gaseous flow produced by the smoking article In some embodiments, the additive releasing material releases the additive(s) at a predetermined point during the use of the smoking article.

In some embodiments, the additive releasing material releases the additive(s) only during the last 3 puffs during complete use of the smoking article, only during the last 2 puffs, or only during the last puff of the smoking article.

According to a third aspect of the present invention, a smoking article is provided, comprising an additive releasing material according to the first aspect of the invention, or a filter according to the second aspect.

In some embodiments, the smoking article comprises a rod of smokeable material to be combusted, and a filter comprising the additive releasing material.

In some embodiments, the smoking article is a nicotine inhalation device and the additive releasing material is provided in a part of the device which is exposed to gradually increasing temperature during use.

According to a fourth aspect of the present invention, a method for preparing an additive releasing material is provided, the method comprising applying one or more additives to the surface of a carrier, wherein the additive(s) and/or the carrier and/or the amount of additive(s) are selected to provide the additive releasing material with a desired desorption temperature selected to allow controlled temperature-dependent release of the additive(s).

BRIEF DESCRIPTION OF THE FIGURES

For the purposes of example only, embodiments of the invention are described below with reference to the accompanying drawings, in which:

The Figure is an illustration of a smoking article including a filter including an additive releasing material according to some embodiments of the present invention.

DETAILED DESCRIPTION

As used herein, the term "smoking article" includes smokeable products such as cigarettes, cigars and cigarillos whether based on tobacco, tobacco derivatives, expanded tobacco, reconstituted tobacco or tobacco substitutes. In addition, herein the term "smoking article" also encompasses products in which a tobacco-derived and/or nicotine-based aerosol or vapour is delivered, including so-called heat-not-burn products in which tobacco is heated but not combusted, and electronic cigarettes and other inhalation devices delivering desired compounds such as nicotine in inhalable form.

In some embodiments, the smoking article may be provided with a filter for the gaseous flow drawn by the smoker. The filter may be provided at or near the mouth end of the product, so that the gaseous flow travels through the filter prior to being released from the product and inhaled by the consumer.

In some embodiments, the filter may be provided in the smoking article for purposes other than smoke filtration, and the properties of the filter may accordingly be different.

Referring to the Figure, for purpose of illustration and not limitation, a smoking article 1 according to an exemplary embodiment of the invention comprises a filter 2 and a cylindrical rod of smokeable material 3, such as tobacco, aligned with the filter 2 such that one end of the smokeable material rod 3 abuts the end of the filter 2. The filter 2 is wrapped in a plug wrap (not shown) and the smokeable material rod 3 is joined to the filter 2 by tipping paper (not shown) in a conventional manner. The filter 2 is substantially cylindrical and has a mouth end 4 and a smokeable material end 5. The filter 2 comprises an additive releasing material according to the present invention, providing temperature-dependent, controlled release of the additive at a desired point during the use of the smoking article.

The plug of filter material preferably has a size and shape suitable to match the size and shape of the rod of smokeable material to which it is to be attached in a finished smoking article.

Although the illustrated smoking article 1 includes a filter 2 having a single filter element or segment, other arrangements are possible. For instance, the filter 2 can comprise multiple segments, such as 2, 3 or more segments, with some or all of the segments comprising the additive releasing material according to the invention.

Many different filter arrangements for smoking articles are contemplated, including composite filters wherein the filter comprises a plurality of separate filter elements or sections with different filtering capacities, and/or comprising different materials, such as different filter materials and additives, such as adsorbents and flavourants. As used herein, the term "flavourant" refers to materials which, where local regulations permit, may be used to create a desired taste or aroma in a product.

It has been found that the temperature in the filter of a smoking article varies over time during the smoking or use of the article (see Purkis et al, "The Influence of Cigarette Designs and Smoking Regimes on Vapour Phase Yields" Contributions to Tobacco Research, Vol 24, No. 1, pp 33-46, April 2010). The temperature is initially fairly constant, from one puff to the next for the first puffs. Thereafter, during the final 2-3 puffs, the puffs are accompanied by higher peaks in temperature. The changes in the filter occur predominantly due to the 'hot' cigarette coal advancing towards the filter during combustion of the tobacco rod.

In a conventional combustible smoking article, such as a cigarette, and under normal smoking conditions, such as the ISO smoking regime, the smoking may involve 8-9 puffs and the first 5-6 puffs are accompanied by only slight increases in temperature during the puffs. For example, the first puffs may be accompanied by a temporary increase in temperature of in the region of 1-5 ° C., with the temperature remaining between 20 and 30 ° C., and in some cases, between 23 and 26 ° C. During the final 3 puffs of a conventional combustible smoking article, such as a cigarette, the temperature starts to increase more during the puffs, with peaks starting to exceed 30 ° C., and exceeding 60 ° C. for the penultimate and last puffs.

Therefore, there is a marked increase in the temperature in the filter when the consumer reaches the last puff or last few puffs when using a smoking article, towards the end of the smoking experience.

The effects are greater when the cigarette is smoked more aggressively, for example, where the smoker takes longer and/or larger and/or more frequent puffs. The smoking regime may affect the temperatures in the filter, with faster or more active smoking resulting in higher temperatures and/or the higher peaks in the temperature being observed sooner during smoking.

The temperature in the filter during smoking will also vary along the length of the filter rod, with the temperature being higher at the end adjacent the tobacco rod compared to at the mouth end. For example, at 20 mm from the mouth end in a conventional King Size cigarette, the temperature may reach 40-80 ° C. At 5 mm from the mouth end, the temperature may reach 30-60 ° C.

The precise temperature in the filter during puffs will also depend, to an extent, on some of the properties of the filter itself. The heat conductivity of materials in the filter, including the filter material (sheet or tow) and any additives included will likely have an impact on the temperature.

Nevertheless, regardless of the variation that can be seen as a result of the materials, the smoking regime and the position of the material within the filter, the pattern of temperature fluctuations during smoking or use will generally be replicated so that the temperature in the filter will reach or exceed a given threshold temperature at a predetermined point in the smoking process of use of the smoking article.

Whilst it is known to include flavours or flavourants in a smoking article to impart a flavour or taste to the smoke, the timing of the release of the flavour is generally either uncontrolled or it is controlled by the consumer, for example by crushing a flavour-containing capsule in the filter when the flavour is desired. In some circumstances, and especially where the flavour is gradually released during the smoking of the smoking article, the flavour may gradually diminish in strength (as perceived by the consumer inhaling the smoke), so that the effect of the flavour may be weakened or even lost by the time the consumer reaches the last puff or last few puffs.

In contrast to the known flavoured smoking articles, it may be desirable to release the flavour only at the end of the smoking experience, to impart flavour to the smoke in the final puff or final few puffs, to leave the smoker with a pleasant or desirable taste. This may be achieved by the consumer triggering flavour release, for example by manually manipulating the filter or another part of the smoking article, but currently this is not achieved automatically without the need for consumer action.

It is known to use porous adsorbent materials to adsorb certain constituents of tobacco smoke as they pass through the filter. Commonly used adsorbent materials include activated carbon, synthetic resins, zeolite, silica, sepiolite and other porous clays. These porous adsorbents tend to have micropores but can also include additional mesopores to trap the vapour phase smoke constituents.

It is also known, for example from WO 2004/047571 (Filtrona International Limited), to impregnate porous carbon with menthol to provide both a source of menthol flavour and an adsorbent to filter the tobacco smoke. The release of menthol from this impregnated porous carbon is uncontrolled and gradual over the period of consuming the smoking article. As the menthol is gradually released, the pores thereby vacated become available for adsorption of vapour phase smoke constituents.

In contrast, the additive release materials according to some embodiments of the present invention release the additive in a temperature dependent manner, with the additive being released only when the temperature reaches or exceeds a threshold temperature. In some embodiments, the release of the additive from the additive release material is not triggered (in the absence of the required temperature being reached) through contact of the additive release material with tobacco smoke, and more specifically, through contact with the smoke particulate matter.

The inventors have recognised that the increase in temperature of the filter at the end of the smoking of a smoking article may be used to control and/or trigger the release of an additive from the surface of a carrier material. The properties of the additive and of the carrier material combine to ensure that the additive is not released at room temperature or within the range of temperatures to which the smoking articles may be exposed during manufacture, transport and storage. The additive will only be released from the additive releasing material to a significant extent when the material is heated to or above a threshold temperature which triggers release. As the temperature in the filter of a smoking article increases with each puff during smoking, the additive releasing material may be tailored to provide temperature-dependent release of the additive at a desired point during smoking.

In some embodiments, the additive is a flavour and/or may impart a flavour or another organoleptic effect to the consumer. The inclusion of some additives of this type or nature is regulated and such additives can only be used where local regulations permit.

According to some embodiments of the present invention, a flavour is provided so that the increased temperature in the filter smoking article during the last puff or last few puffs triggers release.

As referred to herein, the "additive releasing material" is the carrier material with the additive material adsorbed to its surface.

In some embodiments, the additive included in the additive releasing material, that is, the additive adsorbed to the surface of the carrier material, comprises a mixture of two or more additives.

The temperature at or above which the additive is released from the surface of the porous carrier material is referred to herein as the "desorption temperature". This temperature is dependent upon the properties of both the additive and of the carrier. Thus, the desorption temperature as referred to herein is a property of the additive releasing material, which carries upon its surface the additive to be released.

The desorption temperature is preferably above room temperature or ambient temperature, and, in some embodiments, it is above the elevated temperatures to which smoking articles or elements thereof may be exposed during manufacture, transport and storage. In some embodiments, the desorption temperature may be no less than about 35 ° C. In some embodiments, the desorption temperature may be no less than about 45 ° C., about 50 ° C., about 55 ° C., about 60 ° C., about 65 ° C., about 70 ° C., about 75 ° C., about 80 ° C., about 85 ° C., about 90 ° C., about 95 ° C. or no less than about 100 ° C. In addition, in some embodiments, the desorption temperature may be no more than about 120 ° C., about 115 ° C., about 110 ° C., about 105 ° C., about 100 ° C., about 95 ° C., about 90 ° C., about 85 ° C., about 80 ° C., about 75 ° C., about 70 ° C., about 65 ° C., about 60 ° C., about 55 ° C., about 50 ° C., about 45 ° C., or no more than about 40 ° C. In some embodiments, the desorption temperature is selected based upon the proposed location of the additive releasing material within the filter.

In some particular embodiments, the desorption temperature may be within the range of from about 45 ° C., about 55 ° C., about 60 ° C. or from about 65 ° C., and up to about 60 ° C., about 65 ° C. or up to about 70 ° C. For example, the desorption temperature may be within the range of from about 45 ° C. to about 60 ° C., from about 50 ° C. to about 60 ° C., from about 55 ° C. to about 60 ° C., or from about 60 ° C. to about 65 ° C.

As discussed above, the temperature in parts of a smoking article increase over time as the smoking article is used. The temperature profile over time of the part of the smoking article where the additive releasing material is to be located may be used to determine a threshold temperature range which is not reached before the point at which release of the additive is desired, but which is reached or exceeded at the point at which release of the additive is desired, and optionally which is also reached or exceeded thereafter.

In order to provide temperature-dependent release of the additive from the surface of the carrier material, the additive releasing material has a desorption temperature which falls within the threshold temperature range.

The additive releasing material may, in some embodiments, be tailored to release the additive (for example, the flavour) from its surface when the additive releasing material is exposed to a gas flow having a temperature at or exceeding the threshold temperature range. In some embodiments, the additive releasing material releases the additive from its surface when the part of the smoking article in which the material is located is heated to or above the threshold temperature range. In some embodiments, the additive releasing material releases the additive from its surface when the material is heated to or above the threshold temperature range.

In some embodiments, for example where the additive releasing material is included in a conventional combustible smoking article and the release of the additive is to occur during the last or final few puffs, the threshold temperature range may be from about 45 ° C., about 55 ° C., about 60 ° C. or from about 65 ° C., and up to about 60 ° C., about 65 ° C. or up to about 70 ° C. For example, the threshold temperature range may be from about 45 ° C. to about 60 ° C., from about 50 ° C. to about 60 ° C., from about 55 ° C. to about 60 ° C., or from about 60 ° C. to about 65 ° C. In such embodiments, the additive releasing material may release the additive during the last puff or last few puffs by having a desorption temperature within the threshold temperature range.

In some embodiments, the amount of additive adsorbed onto the surface of the carrier is selected to provide the desired amount of additive to be delivered into the smoke. In some embodiments, the adsorbent should not be saturated (i.e. the pores should not be completely filled) with the additive compound as this could, for example, result in a residual odour at room temperature. In some embodiments, it may be advantageous to fill between 10% and 90% of the total pore volume with the additive. However, as discussed below, the amount of additive adsorbed onto the carrier has an effect on the desorption temperature of the additive releasing material. Therefore, in order to deliver more additive, it may, in some embodiments, be appropriate to include more additive releasing material rather than more additive in the additive releasing material, so that a desired desorption temperature may be attained.

This approach to providing temperature-dependent controlled additive release could be used in a variety of tobacco or non-tobacco industry products, including so-called heat not burn products and electronic cigarettes. The additive releasing material can be designed to release the additive at a very wide range of temperatures, and so these materials may be used in any product where there is a progressive increase in temperature at a location within the product where the additive releasing material may be located.

Thus, for other products, additive releasing materials may be prepared which release the additive at temperatures above 80 ° C. or above 100 ° C. For example, menthol is released from a microporous activated carbon at a temperature above about 200 ° C. As discussed above, the desorption temperature is dependent on the carrier material and the additive material to be released. As a rough guide, the smaller the pore size on the surface of the carrier, the higher the temperature needed to release the additive. Additionally, the lower the additive vapour pressure (the higher the boiling point), the higher the temperature needed to release the additive.

In some embodiments of the present invention, a carrier material is provided, which carries the additive to be released in a temperature-dependent manner. The carrier retains the additive so that it does not migrate or is not released before the desired time. The additive may be held on the surface of the carrier until the conditions for release, i.e. desorption of the additive from the surface of the carrier, are met.

In some embodiments, the carrier is a porous material. In such embodiments, the additive may be held in the pores of the porous carrier until released. In some embodiments, the porous carrier material has mesopores and/or micropores on its surface and at least some of the additive may be held within these pores. In some embodiments, the carrier material is a porous material having mesopores, at least some of which hold the additive until the conditions for release are met.

In some embodiments, the porous carrier is activated carbon (also sometimes called active carbon or charcoal). This may be derived from natural sources, such as vegetable matter (for example, coconut carbon), or it may be manufactured from a synthetic resin (for example, as sold by Blücher GmbH). Other suitable carrier materials include the adsorbent materials discussed in Branton et al, Adsorption Science & Technology, 29(2), 117-138 (2011).

The porosity of many of the porous carrier materials that can be used in the present invention may be controlled to provide a desired total surface area, total pore volume and pore size distribution. For the purposes of this invention, in some embodiments, the porous activated carbon may have mesopores as well as micropores.

As a general principle, it is easier to release an additive from a mesopore, as it will be less tightly held, but if you want the additive to be released at a high temperature, a microporous material may be preferred.

In some embodiments, the carrier is capable of trapping the additive to be carried at room temperature, and of releasing the additive at higher temperatures, preferably at or above a predetermined threshold temperature.

In some embodiments, the physical and/or chemical properties of the carrier material, and in particular the pore size and distribution on the surface of the carrier material is an important factor in achieving the desired controlled, temperature-dependent release of the additive it carries. The preferred characteristics of the carrier material may be different for different additives.

In some embodiments, the porous carrier is activated carbon similar to or the same as the activated carbon commonly used as an adsorbent in conventional smoking articles.

The activated carbon used may be provided in monolithic or particulate form. In some embodiments, particles will have a particle size in the range of between 10 μm and 1000 μm. In some embodiments, the mean particle size is between 50 μm and 500 μm, between 100 μm and 400 μm or between 150 μm and 250 μm.

The properties of the additive will have a significant influence on the desorption temperature and therefore on the temperature at which the additive will be released by desorption from the surface of the carrier.

It has been discovered that, as a rule, the higher the molecular weight of the additive, the higher the desorption temperature. In some embodiments where a desorption temperature of approximately 45 to 80 ° C. is desired, it may be useful to select an additive having a molecular weight in the range of 50-100 g/mol. However, it should also be noted that other factors may be changed to adjust the desorption temperature of the additive releasing material, such as the amount of additive loaded and the properties of the carrier.

In some embodiments, the additive has a molecular weight of less than 100 g/mol. In some embodiments, the additive does not consist of or consist essentially of menthol. In some embodiments, an additive material applied to the surface of a carrier material may comprise a mixture of additives. For example, in some embodiments, the additive material may comprise a mixture of flavours to give the desired taste/flavour profile upon release. In some embodiments, the mixture of additives does not include menthol.

In some embodiments, the additive releasing material comprises at least about 20% additive by weight. In some embodiments, the additive releasing material comprises at least about 30% additive by weight, about 40%, about 45%, about 50%, about 55%, about 60%, about 65%, about 70%, about 75%, about 80%, about 85% or at least about 90% additive by weight.

In some embodiments, the additive is a flavour. As used herein, the terms "flavour" and "flavourant" refer to materials which, where local regulations permit, may be used to create a desired taste or aroma in a product for adult consumers.

In some embodiments, the flavour or flavours may be selected based upon the release temperature, i.e. the predetermined threshold range. Any flavour with some volatility at the temperatures required may be used. For example, many esters have suitable volatility for use in the present invention.

As used herein, the terms "flavour" and "flavourant" refer to materials which, where local regulations permit, may be used to create a desired taste or aroma in a product for adult consumers, provided that they meet the chemical requirements to render them useful in the proposed mode of storage and delivery. They may include extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie™ (liqueur made from Scotch whisky, heather honey, herbs and spices), bourbon, scotch, whiskey, spearmint, peppermint, lavender, cardamon, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus *Mentha*), flavour enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder.

In some embodiments, the additive may be loaded onto the surface of the porous carrier by exposing the carrier to the additive for a period of time sufficient to provide the desired level of loading, that is, to provide the desired percent by weight of the additive in the additive releasing material.

Where the additive material comprises two or more additives, these may be applied as a mixture or sequentially, or in a combination of these options.

In some embodiments, the loading of the additive onto the porous carrier material may be carried out within a closed vial. In some embodiments, the additive is provided in liquid form and is applied to the surface of the carrier. For example, the liquid additive may be sprayed onto the carrier or the carrier may be soaked in the liquid additive. In some alternative embodiments, the additive is in solid form and it is applied to the surface of the carrier by subliming and then being deposited on the surface of the carrier. Most additives used in this invention will be in liquid form at room temperature and pressure (will have a specific vapour pressure). In some embodiments, the loading of the additive onto the carrier material may involve using a sealed system and reduced pressure, so that vapour from the liquid additive can be adsorbed by the adsorbent.

In some embodiments, the loading of the additive onto the porous carrier material may be carried out at room temperature.

In some embodiments, the period for which the porous carrier material is exposed to the additive may be from about 10 minutes to about 240 hours. Generally, a longer period of exposure results in a greater amount of additive being adsorbed onto the surface of the porous carrier.

Further factors that may affect the amount or rate of loading are the temperature and pressure under which the exposure of the porous carrier to the additive occurs.

In some embodiments, a method of preparing an additive releasing material for temperature-dependent release of an additive involves, first determining the threshold temperature range at the proposed location of use of the additive releasing material and then preparing the additive releasing material so that it has a desorption temperature with the threshold temperature range.

In addition to the adjustment of the desorption temperature of the additive releasing material it may, to some extent, also be possible in some embodiments to adjust the temperature the additive releasing material is exposed to during smoking. For example, in some embodiments this may be achieved by selection of the position of the additive releasing material along the length of the filter. Alternatively or in addition, in some embodiments, the filter may include further additives to increase or decrease the temperature. Finally, in some embodiments, the construction of the filter and/or the smoking article it is incorporated in may be chosen to control the temperature, for example by drawing cool or hot air into the filter by means of vents or the like.

Thus, for example, if the additive to be released is more volatile, a lower temperature is required for its release and thus the material could be positioned further away from the tobacco rod section and nearer the mouth.

The additive releasing material may, in some embodiments, be included in a filter such as a filter for a conventional smoking article. Such filters generally comprise a plug of filter material, such as a cellulose acetate tow or a paper or other sheet material.

In some embodiments, the additive releasing material may be dispersed ("dalmatian" style) throughout the filter material in the whole or a section of the filter. In alternative embodiments, the additive releasing material may be incorporated into the filter in a cavity. In yet further embodiments, which may be combined with one or both of the foregoing arrangements, the additive releasing material may be attached to a support structure, such as the internal surface of the wrap circumscribing the plug of filter material, for example in the form of a patch.

The filter may, in some embodiments, comprise multiple segments or elements and the additive releasing material may be present in one or more of these segments or elements.

Alternatively, some products may not include a filter or it may not be possible or appropriate to include the additive releasing material in the filter. In such embodiments, which may include the inhalation devices mentioned above, the additive releasing material may be included in a cavity or in an alternative supporting material or means.

Other components may be included in the smoking article with the additive releasing material. In some embodiments, porous adsorbent material is included, for example for the adsorption and selective removal of vapour phase constituents of tobacco smoke. The additive releasing material does not act as an adsorbent when the additive is present on the surface of the carrier and so the material does not remove constituents from the gaseous flow through the smoking article.

In some embodiments, the porous adsorbent material may be activated carbon or the like. In some embodiments it is a material with a porous surface having suitable properties for selectively removing vapour phase constituents of the gaseous flow to which it is exposed in the smoking article. In some embodiments, the adsorbent material is upstream of the additive releasing material, so that the adsorbent removes constituents from the gaseous flow before the gaseous flow reaches the additive releasing material. Additionally or alternatively, in some embodiments the adsorbent material is downstream of the additive releasing material, so that the adsorbent removes constituents from the gaseous flow after the gaseous flow passes the additive releasing material.

In some embodiments, the additive releasing material will provide substantially no adsorption of vapour phase smoke constituents until the flavour is released and therefore little or no adsorption during the consumption of the smoking article. In some embodiments, the additive releasing material does not provide any significant adsorption at all during the use of the smoking article.

In some embodiments, the smoking article may, in the vicinity of proposed location of the additive releasing material, include a material or means for controlling and/or adjusting the temperature.

Experimental

Experiments were carried out to determine the release temperature (desorption temperature) of different additives with various amounts loaded on one porous carrier material, an active carbon sample. The active carbon used was a polymer-derived steam activated carbon containing micropores and mesopores, with surface area of approximately 1700 $m^2/g$ and total pore volume of approximately 1.1 $cm^3/g$.

The additives used in the experiments were ethyl acetate (EA) (99.8%, from Sigma-Aldrich, 907-022-00-5) and L-menthol (LM) (>99%, from Sigma-Aldrich, W266523-100G-K).

The EA samples were loaded with a high amount (87 wt %) and a low amount (13 wt %) of EA. The LM sample was only loaded with a high amount of EA (71 wt %). The samples were loaded within a closed vial by exposing the carbon to the flavours for different periods of time:

Sample 1: EA 87 wt %—loaded with EA with an exposure time of 48 hours

Sample 2: EA 13 wt %—loaded with EA with an exposure time of 1 hour

Sample 3: LM 71 wt %—loaded with LM with an exposure time of 150 hours

The release temperature (desorption temperature) was calculated by Temperature Programmed Desorption (TPD). 0.1 g of the sample was placed within a TPD test cell where the sample was located in a continuous nitrogen stream. The sample cell was placed in an oven and exposed to different heating rates (2, 5 & 10 K/min). From the TPD data the maximum temperature of desorption was determined. Subsequently, the maximum temperature of desorption was extrapolated to a theoretical heating rate of 0 K/min (Table 1).

The determined maximum temperature of desorption depends mainly on the released additive (Table 1). The maximum temperature of desorption for EA was shown to also depend upon the amount of additive loaded (see Table 1).

TABLE 1

Maximum desorption temperatures determined with TPD (at a theoretical heating rate of o K/min)

| Additive | Heating rate [K/min] | Amount loaded [wt. %] | Desorption Temperature [° C.] |
|---|---|---|---|
| EA | o | 87 | 59 |
| EA | o | 13 | 103 |
| LM | o | 71 | 362 |

It can be assumed the higher the molecular weight of the additive the higher the desorption temperature. This means EA (M=88.1 g/mole) desorbs at lower temperatures than LM (M=156.3 g/mole) (Table 1). This is because of the adsorption potential which depends on the interaction between the additive and the sorbent. It becomes higher as the additive molecular weight increases (Table 1).

In this experiment, another influence on the desorption temperature is the amount of flavour loaded. This means the greater the amount of additive loaded onto the sorbent the lower the desorption temperature (Table 1). This is because of the adsorption potential, which depends on the interaction between the additive and the carrier and which reduces as the average carrier pore diameter increases. The smaller pores are filled first and the interactions between additive and carrier are stronger the smaller the pore size meaning release is harder. The active carbon sample used in the examples had a polymodal pore size distribution.

As the temperature in the cigarette filter rises up to around 60-80 ° C., this is an appropriate threshold or release temperature range if the additive is to be released during final puff or final few puffs of a conventional combustible cigarette. EA seems to be a promising additive for such use, as its desorption temperature of 59 ° C. (at a theoretical heating rate of 0 K/min) correlates with the temperature in the cigarette filter.

From this experiment, the high molecular weight of LM would appear to suggest that its adsorption potential will be high. The data suggests that the temperature of desorption of LM is 362 ° C. (at a theoretical heating rate of 0 K/min). As a result, LM, and menthol in general, are considered to be unsuitable for use as an additive according to the present invention where the additive releasing material is for inclusion in the filter of a conventional cigarette. As discussed above, the temperatures reached in filters of conventional cigarettes (with conventional filters) are significantly lower than the temperature required to release menthol by desorption from the surface of a carrier material. However, it is possible that menthol could be suitable for use in additive releasing materials intended for use in devices where the material is or may be exposed to higher temperatures.

Therefore, in some embodiments, the additive releasing material does not comprise an additive consisting of menthol, forms of menthol and/or derivatives of menthol. In some embodiments, the additive releasing material does not comprise menthol or forms of menthol.

In a further experiment, ethyl butyrate (EB) (99%, sourced from Alfa Aesar) was used as the additive and was loaded on same porous carbon carrier as used in the previous experiment and in the same manner.

Sample 4: EB 73 wt %—loaded with EB with an exposure time of 48 hours

Sample 5: EB 27 wt %—loaded with EB with an exposure time of 12 hours.

TABLE 2

Maximum desorption temperatures determined with TPD (at a theoretical heating rate of o K/min)

| Additive | Heating rate [K/min] | Amount loaded [wt. %] | Desorption Temperature [° C.] |
|---|---|---|---|
| EB | o | 73 | 74 |
| EB | o | 27 | 139 |

EB seems to be a promising additive for use as an additive in the additive releasing material of the present invention, as its desorption temperature of 74 ° C. (at a theoretical heating rate of 0 K/min) correlates with the temperature in the cigarette filter.

In summary, the experiments indicate that the more volatile the additive, the lower the desorption temperature.

Furthermore, it would also appear that additive which is trapped in micropores on the surface of the carrier is more difficult to release, whilst the additive present in the mesopores is more readily released. This appears to be the reason why the release temperature is higher for an additive release material with lower additive loading. When the additive is deposited on the surface of the carrier, the micropores are filled first. Therefore, for a material with low additive loading release will have to be from micropores which is harder than from mesopores. Nevertheless, additive will be released from micropores, especially at higher temperatures.

Thus, the size of the pores on the surface of the carrier and/or the amount of additive may be adjusted to achieve the desired desorption temperature of the additive releasing material, to tailor the material to the temperatures it will be exposed to and to achieve the desired temperature-dependent release.

In order to address various issues and advance the art, the entirety of this disclosure shows by way of illustration various embodiments in which the claimed invention(s) may be practiced and provide superior additive release materials.

The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A smoking article filter comprising an additive releasing material, the additive releasing material comprising a porous carrier material having adsorbed on its surface one or more additives, the additive releasing material having a desorption temperature from about 45° C. to about 70° C. such that the additive(s) is (are) released by desorption only after the first 5 to 6 puffs during use of the smoking article, wherein from 10% to 90% of the total pore volume of the porous carrier material is filled with the additive(s), and wherein the additive releasing material comprises at least 30% additive by weight, wherein the additive or at least one of the additives has a molecular weight of 50 to 100 g/mol.

2. The smoking article filter as claimed in claim 1, wherein the additive releasing material does not release the additive(s) until the material is exposed to a temperature at or above the desorption temperature.

3. The smoking article filter as claimed in claim 1, wherein the porous carrier has micropores, mesopores and/or macropores within which the additive is held.

4. The smoking article filter as claimed in claim 3, wherein the porous carrier is a material selected from the group consisting of: activated carbon, resins, zeolites, silicas, sepiolite and other porous clays.

5. The filter as claimed in claim 1, wherein the filter further comprises an adsorbent material which does not carry an additive on its surface.

6. The filter as claimed in claim 5, wherein the adsorbent material provides the selective adsorption of certain constituents of the gaseous flow produced by the smoking article.

7. The filter as claimed in claim 6, wherein the additive releasing material releases the additive(s) at a predetermined point during the use of the smoking article.

8. The filter as claimed in claim 7, wherein the additive releasing material releases the additive(s) only during the last 3 puffs during complete use of the smoking article.

9. A smoking article comprising the filter as claimed in claim 1, wherein the smoking article comprises a rod of smokeable material to be combusted, and the filter comprising the additive releasing material.

10. A smoking article comprising the additive releasing material of claim 1, wherein the smoking article is a nicotine inhalation device and the additive releasing material is provided in a part of the device which is exposed to gradually increasing temperature during use.

11. The smoking article filter as claimed in claim 1, wherein the additive is inhaled by the consumer.

12. A smoking article filter comprising an additive releasing material, the additive releasing material comprising a porous carrier material having adsorbed on its surface one or more additives, wherein from 10% to 90% of the total pore volume of the porous carrier material is filled with the additive(s), and wherein the additive(s) and/or an amount thereof added to the porous carrier material are selected to provide the additive releasing material with a desorption temperature at which the additive(s) is (are) released from the surface of the porous carrier material of from about 45° C. to about 70° C. during use of the smoking article, wherein the additive releasing material comprises at least 30% additive by weight, wherein the additive or at least one of the additives has a molecular weight of 50 to 100 g/mol.

13. A smoking article filter comprising an additive releasing material, the additive releasing material comprising a porous carrier material having adsorbed on its surface one or more additives, wherein from 10% to 90% of the total pore volume of the porous carrier material is filled with the additive(s) and wherein the additive releasing material comprises at least 30% additive by weight, and wherein the additive releasing material releases the additive(s) from the surface of the porous carrier material by desorption when the material is exposed to a temperature at a desorption temperature of from about 45° C. to about 70° C., wherein the additive or at least one of the additives has a molecular weight of 50 to 100 g/mol.

14. An additive releasing material as recited in claim 1 for use in a smoking article, the additive releasing material comprising the porous carrier material having adsorbed on its surface the one or more additives, the additive releasing material having the desorption temperature of from about 45° C. to about 70° C. such that the additive(s) is (are) released by desorption only after the first 5 to 6 puffs during use of the smoking article under ISO smoking regime, wherein from 10% to 90% of the total pore volume of the porous carrier material is filled with the additive(s), and wherein the additive releasing material comprises at least 30% additive by weight, wherein the additive or at least one of the additives has the molecular weight of 50 to 100 g/mol.

15. A method for preparing the additive releasing material as claimed in claim 8 for use in the smoking article, comprising applying the one or more additive to the surface of the porous carrier, wherein the additive(s) and/or the carrierand/or the amount of the additive(s) are selected to provide the additive release material with the desorption temperature of from about 45° C. to about 70° C. such that the additive(s) is (are) released by desorption afterthe first 5 or 6 puffs during use of the smoking article under ISO smoking regime, wherein the applying the one or more additives to the surface of the porous carrier comprises filling 10% to 90% of the total pore volume of the porous carrier material with the additive(s), and wherein the additive releasing material comprises at least 30% additive by weight, wherein the additive or at least one of the additives has a molecularweight of 50 to 100 g/mol.

* * * * *